US007611021B2

(12) United States Patent
Willim

(10) Patent No.: US 7,611,021 B2
(45) Date of Patent: Nov. 3, 2009

(54) CRANE VEHICLE

(75) Inventor: Hans-Dieter Willim, Ulm-Unterweiler (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 0 days.

(21) Appl. No.: 12/005,232

(22) Filed: Dec. 26, 2007

(65) Prior Publication Data

US 2008/0173606 A1 Jul. 24, 2008

(30) Foreign Application Priority Data

Dec. 22, 2006 (DE) ..... 20 2006 019 421 U

(51) Int. Cl.
*B66C 23/72* (2006.01)

(52) U.S. Cl. ..... 212/178; 212/195

(58) Field of Classification Search ..... 212/178, 212/195

See application file for complete search history.

(56) References Cited

U.S. PATENT DOCUMENTS 5,199,583 A * 4/1993 Weider et al. ..... 212/279
7,354,066 B2 * 4/2008 Yamamoto ..... 280/759

FOREIGN PATENT DOCUMENTS

DE 100 18 028 10/2001
DE 100 19 863 A1 * 10/2001
JP 2003-201089 * 7/2003

* cited by examiner

*Primary Examiner*—Thomas J Brahan
(74) *Attorney, Agent, or Firm*—Dilworth & Barrese LLP

(57) ABSTRACT

The present invention relates to a crane vehicle having a base plate fastenable to its undercarriage to receive ballast and two hoisting means vertically fastened to the part of the superstructure projecting outwardly in the opposite direction to the boom, said hoisting means having first load receiving points which can be moved into cut-outs of connection rods arranged at the base plate and engage there into matched recesses, wherein in accordance with the invention both hoisting means are extended beyond the first load receiving points and are provided at their extended ends with second load receiving points which engage into corresponding shape-matched recesses of the connection rods.

20 Claims, 2 Drawing Sheets

CRANE VEHICLE

BACKGROUND OF THE INVENTION

The invention relates to a crane vehicle having a base plate fastenable to its undercarriage to receive ballast and two hoisting means vertically fastened to the part of the superstructure projecting outwardly in the opposite direction to the boom, said hoisting means having first load receiving points which can be moved into cut-outs of connection rods arranged at the base plate and engage there into matched recesses. In accordance with the invention, both hoisting means are longer beyond the first load receiving points and are provided at their extended ends with second load receiving points which engage into corresponding shape-matched recesses of the connection rods. Due to this embodiment of the hoisting means, they cannot only accept forces, but also torques. The ballasting system is independent of the position of the pivot point of the total ballast due to this additional torque acceptance. The available space can thus be utilized ideally while taking account of the initially named condition. The respective piece of ballast to be placed on can namely have a comparatively large height independently of the position of the center of gravity. The space requirements of the outwardly pivoting superstructure can hereby be considerably reduced.

SUMMARY OF THE INVENTIION

Preferred aspects of the invention also result from the description herein.

The hoisting means are preferably hydraulic cylinders with extensible piston rods supporting the load receiving points. The load receiving points are advantageously holding plates. Other load receiving points such as transverse bolts can, however, also be used instead of holding plates.

Furthermore, the second load receiving points can be formed by a sectional cross-section extension in the end region of the piston rod.

Since the second load receiving means substantially accept the forces perpendicular to the axis of the piston rod, it is sufficient here for the cross-sectional region to be extended in the end region of the piston rod. A region is hereby formed which can engage into a correspondingly matched recess of the connection rod.

Centering regions are formed in the connection rods and the load receiving points can be aligned via them in the direction of the recesses of the connection rod. They are usually conically converging regions within the connection rods through which the first and second load receiving means at the piston rod are introduced into the corresponding recesses formed in the connection rod.

Pieces of ballast can be placed onto the base plate for receiving ballast in dependence on the ballast weight to be received. The pieces of ballast placed on can particularly advantageously be connected to the base plate and to one another in a shape-matched manner. The total stability of the total ballast is hereby increased.

Recesses are formed in the pieces of ballast as a move-in region for the piston rods into the corresponding connection rods of the base plate for receiving ballast.

BRIEF DESCRIPTION OF THE DRAWINGS

Further features, details and advantages of the invention result from an embodiment shown in the drawing. There are shown.

DESCRIPTION OF THE DRAWINGS

Figure 1:
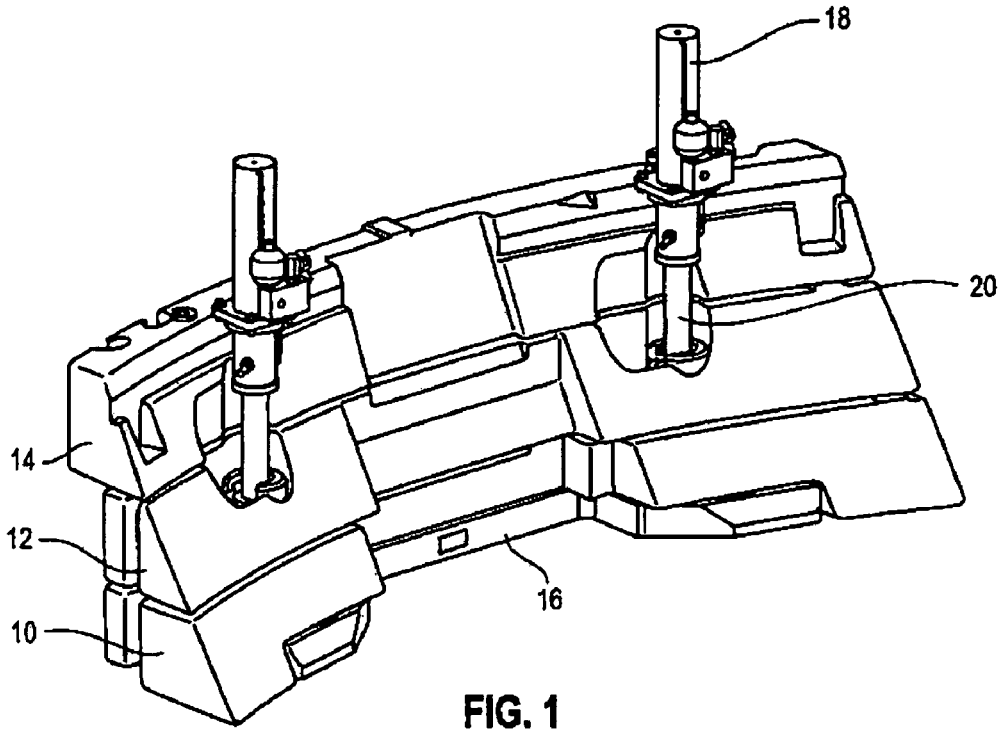
FIG. 1: a perspective view of a ballast with moved in piston rods in accordance with an embodiment of the present invention.

In FIG. 1, a stack of pieces of ballast 10, 12, 14 are deposited in a flush manner on a base plate 16 on a pedestal, not shown in any more detail, of the undercarriage of a crane vehicle likewise not shown here. The ballast plates 10, 12 and 14 have a shape such that they engage into one another in a shape-matched manner. The ballast plate 10 is shaped such that it lies on the base plate 16 in a shape-matched manner.

The pieces of ballast 10, 12 and 14 have a larger height in comparison with known pieces of ballast. A correspondingly high weight can hereby be achieved with a reduction in size of the base surface of the pieces of ballast. The space requirements the superstructure of the crane vehicle requires on the outward pivoting can be reduced due to this smaller base surface of the pieces of ballast.

The total ballast consisting of the pieces of ballast 10, 12 and 14 as well as of the base pate 16 can be received, for example, in the manner known from DE 296 21 600 U1 by hydraulic cylinders which are arranged in the part of the superstructure not shown here.

Figure 2:
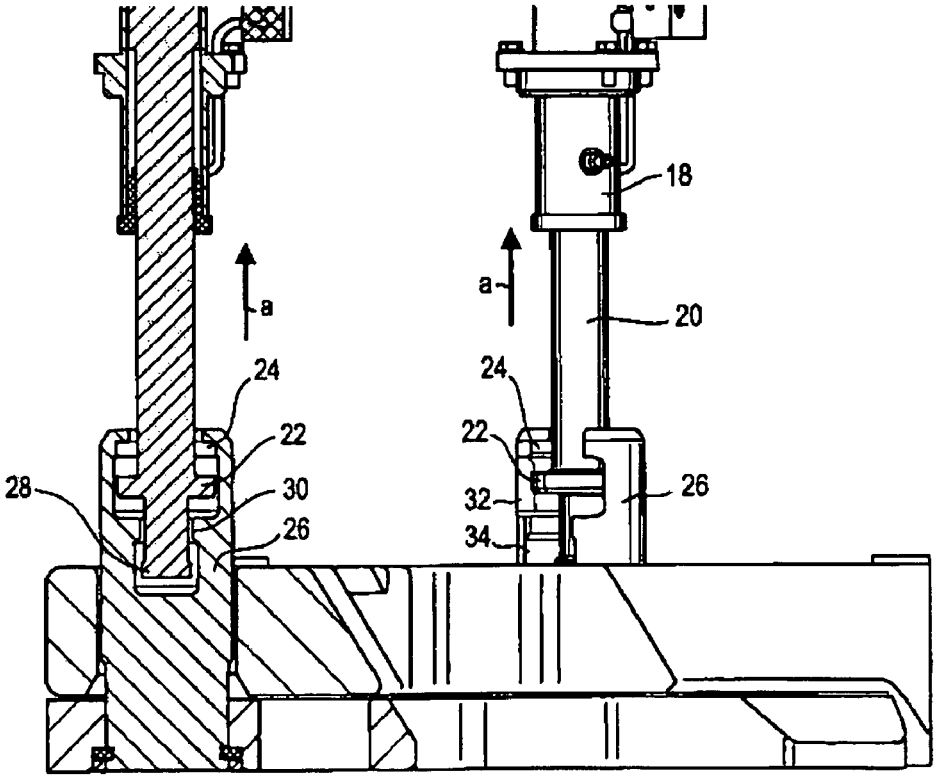
FIG. 2: a partly sectioned representation of a detail of FIG. 1 during the moving in of the piston rods.
Figure 3:
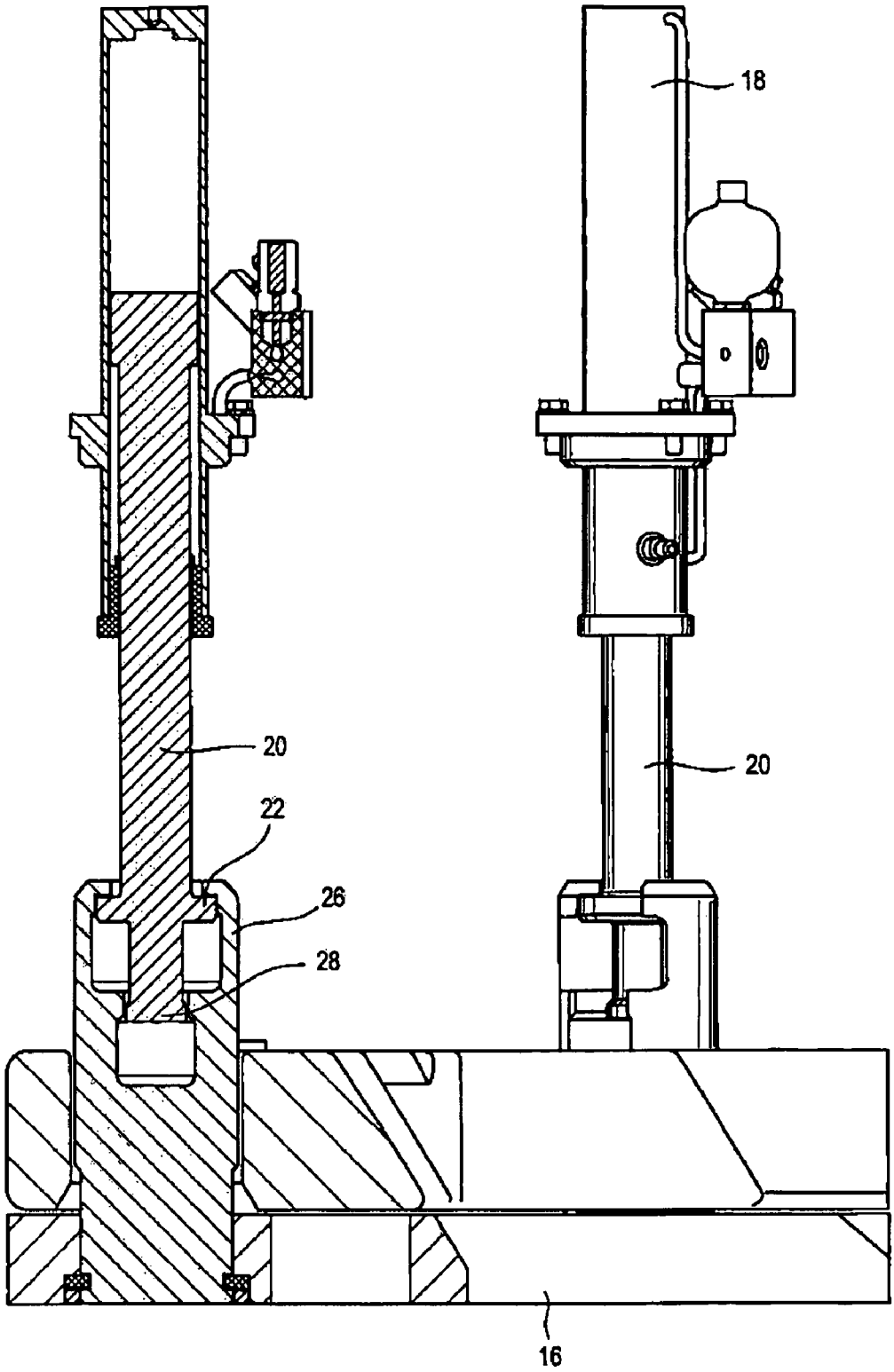
FIG. 3: a representation in accordance with FIG. 2 in which the piston rods are moved into the connection rods of the ballast receiver.

The cylinders 18 and the piston rods 20 are shown in FIGS. 1 to 3. The piston rods 20 have first load receiving points 22 in the form of holding plates. These holding plates engage into corresponding cut-outs 24 of the connection rods 26 which are fastened to the base plate 16.

As described in DE 296 21 690 U1, the piston rods 20 can be pivoted by a pivot movement of the superstructure not shown in any more detail here through corresponding local openings 32 and 34 of the connection rods 26 into said connections rods until they adopt a position in accordance with FIG. 2. Subsequently, the piston rods are drawn up in the direction of the arrow a (cf. FIG. 2) so that the recesses 24 shape-matched into holding plates 22 can be moved inward in the connection rod.

This moved in end position is shown in FIG. 3.

In accordance with the present invention, the piston rods 20 are extended beyond the holding plates 22 and have a second load receiving point 28 at their ends. This load receiving point consists, as can be seen in FIGS. 2 and 3, of a sectional cross-sectional extension in the end region of the piston rod.

A shape-matched receiving region 30 in the connection rod 26 corresponds to this sectional cross-section-extension. As can be seen from the comparison of FIGS. 2 and 3, the second load receiving point 28 moves at the same time as the first load receiving point 22, which is made in the form of the holding plate, simultaneously into the corresponding recess 28 when the piston rod is moved upward in the direction of the arrow a into the coupling position.

The piston rod 20 of each ballasting cylinder 18 is thus designed such that not only forces are absorbed, but also torques. It is hereby achieved that the ballasting system becomes independent of the position of the center of gravity of the total ballast. The space available at the construction site can be utilized ideally while taking account of the now correspondingly possible dimensioning of the ballast pieces.

While taking account of the aforesaid representations, the process of ballasting can be summarized as follows with a crane vehicle in accordance with the invention. The superstructure is moved to the rotary position provided for the ballasting. The piston rods 20 are moved out until the load receiving points 22 and 28 are disposed at the level of the corresponding lateral openings 32 and 34 of the connection rods 20. The superstructure is then rotated to obtain an overlap between the holding plate 22 and the recess 24 in the region of the second load receiving point 28 and the recess 30. The ballast is subsequently raised by the moving in of the piston rod 20. On the moving in of the piston rod, both the holding plate 22 and the second load receiving point 28 move past conically formed centering surfaces and achieve the coupling position (FIG. 3).

The invention claimed is:

1. A crane vehicle having a base plate (16) fastenable to its undercarriage to receive ballast and two hoisting means (18, 20) structured and arranged to be vertically fastened to a part of a the superstructure projecting outwardly in opposite direction to a boom, said hoisting means (18, 20) having first load receiving points (22) structured and arranged to be moved into engagement with cut-outs (32) of connection rods (26) arranged at the base plate (16) and upwardly engage into matched recesses (24) in the connection rods (26), wherein both hoisting means comprise piston rods (20) which are extended beyond the first load receiving points (22) and provided at their extended ends with second load receiving points (28) which are structured and arranged to simultaneously engage into corresponding shape-matched recesses (30) of the connection rods (26) as said hoisting means (18, 20) are upwardly drawn and substantially accept forces perpendicular to an axis of the hoisting means (18, 20), such that said hoisting means (18, 20) absorb torques in addition to forces, and with ballasting independent of position of center of gravity.

2. A crane vehicle in accordance with claim 1, wherein the hoisting means are hydraulic cylinders (18) with said extensible piston rods (20) supporting the load receiving points (22, 28).

3. A crane vehicle in accordance with claim 2, wherein the first load receiving points (22) are holding plates.

4. A crane vehicle in accordance with claim 3, wherein the second load receiving points (28) are formed by sectional cross-section extension in the end region of the respective piston rod (20).

5. A crane vehicle in accordance with claim 4, wherein centering regions are formed in the connection rods and the load receiving points can be aligned via them in the direction of the recesses of the connection rod.

6. A crane vehicle in accordance with claim 5, wherein pieces of ballast can be connected to the base plate.

7. A crane vehicle in accordance with claim 3, wherein centering regions are formed in the connection rods and the load receiving points can be aligned via them in the direction of the recesses of the connection rod.

8. A crane vehicle in accordance with claim 2, wherein the second load receiving points (28) are formed by sectional cross-section extension in the end region of the respective piston rod (20).

9. A crane vehicle in accordance with claim 8, wherein centering regions are formed in the connection rods and the load receiving points can be aligned via them in the direction of the recesses of the connection rod.

10. A crane vehicle in accordance with claim 1, wherein the first load receiving points (22) are holding plates.

11. A crane vehicle in accordance with claim 10, wherein the second load receiving points (28) are formed by sectional cross-section extension in the end region of the respective piston rod (20).

12. A crane vehicle in accordance with claim 11, wherein centering regions are formed in the connection rods and the load receiving points can be aligned via them in the direction of the recesses of the connection rod.

13. A crane vehicle in accordance with claim 10, wherein centering regions are formed in the connection rods and the load receiving points can be aligned via them in the direction of the recesses of the connection rod.

14. A crane vehicle in accordance with claim 1, wherein the second load receiving points (28) are formed by sectional cross-section extension in the end region of the respective piston rod (20).

15. A crane vehicle in accordance with claim 14, wherein centering regions are formed in the connection rods and the load receiving points can be aligned via them in the direction of the recesses of the connection rod.

16. A crane vehicle in accordance with claim 1, wherein centering regions are formed in the connection rods and the load receiving points can be aligned via them in the direction of the recesses of the connection rod.

17. A crane vehicle in accordance with claim 1, wherein pieces of ballast can be connected to the base plate.

18. A crane vehicle in accordance with claim 17, wherein the pieces of ballast placed on can be connected to the base plate and to one another in a shaped-matched manner.

19. A crane vehicle in accordance with claim 17, wherein recesses are formed in the pieces of ballast as a move-in region for the piston rods.

20. A crane vehicle having a base plate (16) fastenable to its undercarriage to receive ballast and two hoisting means (18, 20) structured and arranged to be vertically fastened to a part of a superstructure projecting outwardly in opposite direction to a boom, said hoisting means (18, 20) having first load receiving points (22) structured and arranged to be moved into engagement with cut-outs (32) of connection rods (26) arranged at the base plate (16) and engage into matched recesses (24) in the connection rods (26), wherein both hoisting means are extended beyond the first load receiving points (22) and provided at their extended ends with second load receiving points (28) which are structured and arranged to engage into corresponding shape-matched recesses (30) of the connection rods (26), the hoisting means are hydraulic cylinders (18) with extensible piston rods (20) supporting the load receiving points (22, 28), and centering regions are formed in the connection rods and the load receiving points can be aligned via them in the direction of the recesses of the connection rod.

* * * * *